United States Patent [19]

Falivene

[11] 4,137,345

[45] Jan. 30, 1979

[54] PROCESS FOR THE MANUFACTURE OF FABRIC CONDITIONING ARTICLE

[75] Inventor: Pasquale J. Falivene, Union City, N.J.

[73] Assignee: Colgate Palmolive Company, New York, N.Y.

[21] Appl. No.: 477,916

[22] Filed: Jun. 10, 1974

Related U.S. Application Data

[63] Continuation of Ser. No. 82,238, Oct. 20, 1970, abandoned.

[51] Int. Cl.[2] ..... B05D 3/02; B05D 3/12

[52] U.S. Cl. ..... 427/242; 118/76; 118/423; 427/398 R; 427/422; 427/316

[58] Field of Search ..... 117/47 R, 47 H, 139.5 CQ, 117/139.5 F, 154, 167; 118/76, 423; 427/316, 398, 422, 242

[56] References Cited

U.S. PATENT DOCUMENTS

| | | | |
|---|---|---|---|
| 545,614 | 9/1895 | Roach et al. | 117/139.5 |
| 1,692,822 | 11/1928 | Eckstein | 117/139.5 |
| 2,053,270 | 9/1936 | Dreyfus et al. | 117/139.5 |
| 2,053,305 | 9/1936 | Whitehead | 117/139.5 |
| 3,686,025 | 8/1972 | Morton | 117/140 R |

*Primary Examiner*—Michael R. Lusignan

*Attorney, Agent, or Firm*—Norman Blumenkopf; Herbert S. Sylvester; Murray M. Grill

[57] ABSTRACT

An article for conditioning fabrics by contacting them and applying conditioning material to the fabric surfaces is made by raising the temperature of a conditioning composition including said conditioning material until it forms a melt, in which state it is fluid and readily applicable to a base for the conditioning article, and applying said fluid composition to a base article so that a surface thereof is coated with the composition. Following application, the composition is cooled sufficiently to convert it to the solid state, in which it forms an adherent coating on the base.

The process is especially useful in coating form retaining bases with a layer of a conditioning material such as a fabric softener, which is designed to be rubbed off onto tumbling damp laundry in an automatic laundry dryer, while the dryer is being heated. The method of application lends itself to speedy and commercially satisfactory production techniques, in which the homogeneity of the conditioning composition is maintained, as is the uniformity of the coating, at controllable application rates. Problems associated with flammability of solvents, using evaporation processes to remove solvent materials and the recovery of solvents from the conditioning composition are also obviated.

6 Claims, 5 Drawing Figures

INVENTOR.
PASQUALE JOSEPH FALIVENE
BY Norman Blumenkopf
ATTORNEY

Fig.3.
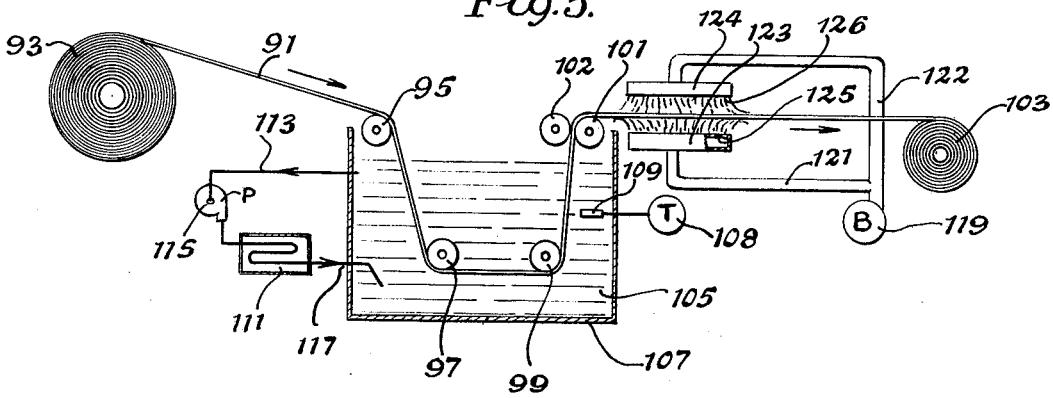
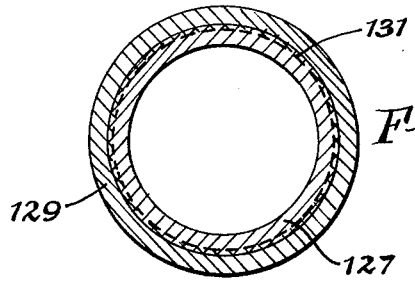
Fig.4.
Fig.5.
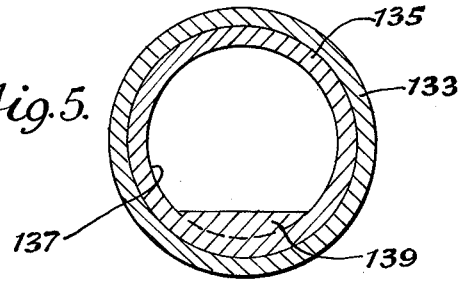
INVENTOR.
PASQUALE JOSEPH FALIVENE
BY Norman Blumenkopf
ATTORNEY

PROCESS FOR THE MANUFACTURE OF FABRIC CONDITIONING ARTICLE

This is a continuation of application Ser. No. 82,238 filed Oct. 20, 1970, now abandoned.

SUBJECT OF THE INVENTION

This invention relates to a method of making articles useful in conditioning fabrics. More particularly, it relates to making fabric softening articles employed in automatic laundry dryers to soften laundered materials.

BACKGROUND OF THE INVENTION

Fibers, yarns and threads, fabrics, manufactured textile articles and laundry have been treated to impart desirable properties to them. They have been made antibacterial, fire-retardant, shrinkproof, stiff, soft, antistatic, soil repellent, creaseproof, permanently pressed, water repellent, and stain resistant. They have been dyed, printed, perfumed, sized, starched and lubricated. Compositions for modifying the yarns, fabrics and manufactured articles made from them have been deposited on the surfaces to be treated as solids, liquids, solutions, dispersions, emulsions, sprays, gases and vapors. They have applied at various temperatures, including those above and below room temperature, although employment at ambient temperatures has generally been preferred.

Treatments of laundry have generally taken place either in the washing machine or after completion of laundering and drying. Thus, laundry has been made soft, antibacterial, antistatic and perfumed by incorporating appropriate materials in the detergent composition or wash water and in some cases, in the rinse water. Sizings, starches, lubricants, such as silicones, water repellents and stain repellent compounds have generally been applied to the laundry after washing and drying, as sprays or in baths. Solvents have been used in the dryer for dry cleaning effects on textiles and water has been dispensed from a container in the dryer to moisten laundry and prepare it for ironing. Powdered absorbents have been mixed with textiles in a tumbling container much like an automatic clothes dryer, to help in removing soil from such articles. Also, pressurized sprays have been used to apply various materials to drying or dried laundry. With respect to softening laundry and making it antistatic, however, the usual method employed in conjunction with the normal home washing process is to incorporate a substantive conditioning agent in the rinse water, from which it is adsorbed onto the laundry, to remain thereon when dried.

Recently, an effort has been made to utilize the dryer for the application of conditioning agents to the laundry in a process which does not greatly modify the ordinary drying operation but allows the coating of the laundry with a conditioning agent during the drying process. In U.S. Pat. No. 3,442,692, it is taught that particular cationic softening agents may be vaporized in the dryer from flexible papers, cloths and sponges, into which they have previously been absorbed. To make such products, solutions of conditioning agents were used and the absorbents were immersed in such solutions and dried before being inserted into the dryer with a load of laundry. Such a method has been found by the present applicant to be inefficient, since much of the absorbed material is unavailable for application to the laundry being treated. Also, the removal of solvents is often a hazardous operation and is generally costly. Because the active conditioning material might melt, heat should be used judiciously in removing solvent. At times, this necessitates the employment of vacuum or low temperature drying techniques. Accordingly, the present invention is considered to be a significant improvement over the procedures of the prior art.

DESCRIPTION OF THE INVENTION

Although various prior art methods for conditioning laundry and softening fabrics are disadvantageous in various ways, use of the present invention allows the production of conditioning articles which are easily employed, safe to use, of excellent effectiveness, reasonably economical to use and easy to manufacture by the present method. The manufacturing method is safe, produces an excellent product, is fast and inexpensive and is adaptable to high speed inexpensive commercial processes which produce exceptionally uniform articles that give reproducible softening and conditioning effects, in use. Although the present invention is useful in making articles for applying conditioning and treating compositions to fabrics or laundry in an apparatus such as an automatic clothes dryer, the articles are primarily useful in conditioning damp, previously laundered textiles and clothing, of either synthetic or natural fibers, to make them soft and free of annoying electrostatic effects.

In accordance with the present invention, a method of manufacturing an article for conditioning fabrics by making contact with them and applying conditioning material to the surfaces of said fabrics comprises raising the temperature of a conditioning composition comprising said conditioning material until it forms a melt, maintaining the melt at a temperature at which it is fluid and readily applicable to a base for the conditioning article, applying said fluid composition to a base article so that a surface thereof, adapted to contact a fabric to be softened, is coated with said composition, and cooling the composition on said surface sufficiently to convert it to a solid state, in which it is adherent to the base. In preferred embodiments of the invention, the conditioning agent is a softening and/or antistatic agent, the base on which it is applied is substantially solid and dimensionally stable, preferably also being form retaining, and the application of the melted conditioning composition is at a temperature in a preferred range, with cooling being effected to about ambient or slightly higher temperature by contact of the coated article with air or other gas to remove heat from the melt. Also preferably, application of the conditioning composition is effected by dipping the article to be coated into a melt of the conditioning composition or by spraying the melted composition onto the surface to be treated. The application of the conditioning agent and cooling thereof are effected relatively quickly, for best results.

Various objects, details, constructions, operations, uses and advantages of the invention will be apparent from the following description, taken in conjunction with the illustrative drawing of some apparatuses for effecting the method of the invention, in which drawing:

THE DRAWING

FIG. 3 is a schematic sectional elevation of a continuous apparatus for applying a melted conditioning agent to the surfaces of a strip or sheet of base material for fabric conditioning articles;

Figure 1:
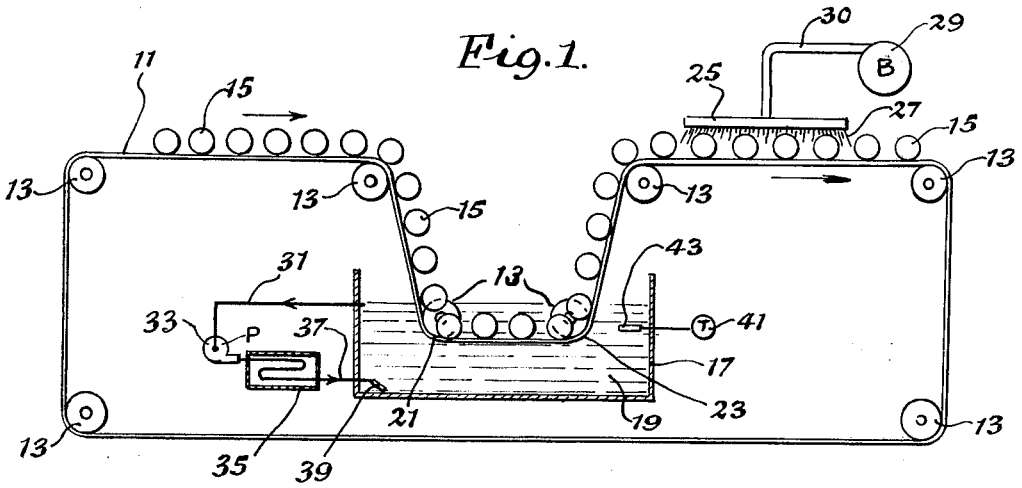
FIG. 1 is a schematic sectional elevation of a continuous apparatus for applying a melt of conditioning agent to the surfaces of bases for fabric conditioning articles.

FIG. 4 is a cross-section of a ball made of paper or other water or solvent absorbing material coated according to the method illustrated in FIG. 1, showing the presence of conditioning agent on the surface of the ball, without penetrating it; and FIG. 5 is a comparative illustration in vertical cross-section of another ball of absorbent material treated with a solution of conditioning agent that had penetrated to the interior thereof, where the conditioning agent is useless in effecting conditioning of fabrics.

DETAILED DESCRIPTION OF THE INVENTION

As is illustrated in FIG. 1, continuous belt 11, moving in the direction of the arrow around rollers 13, carries base articles 15, in this case, fairly light weight hollow balls formed from paper pulp, fastened to the belt by any suitable means, and causes them to descend into a tank 17 containing a melt of coating composition 19. Belt 11 is of open work mesh material and its path into melt 19 is governed by additional end rollers 13 or holding means located near the lower corners 21 and 23. After picking up a coating of the conditioning composition, the coated objects, still held to the belt, are advanced upward and out of the coating composition and under manifold-type distributor 25 through which air 27, supplied by blower 29 and passing through pipe 30 is directed onto the coated articles, to cool them. They are then removed from the belt and packed for shipment, storage and use.

The coating composition 19 in coating tank 17 is maintained at a desirable elevated temperature by circulation through line 31, pump 33 and heat exchanger 35 and back through line 37 into the coating tank. By downwardly directing line 37 at 39, currents are created in the tank and help to maintain the conditioning composition stirred up and homogeneous. Although pump 33 preferably operates continuously, its speed may be adjusted, as desired, to give best coating action. Thermostat 41, responsive to the temperature of the conditioning composition in tank 17, by means of probe 43, regulates the amount of heat added by heat exchanger 35 to the circulating composition.

Figure 2:
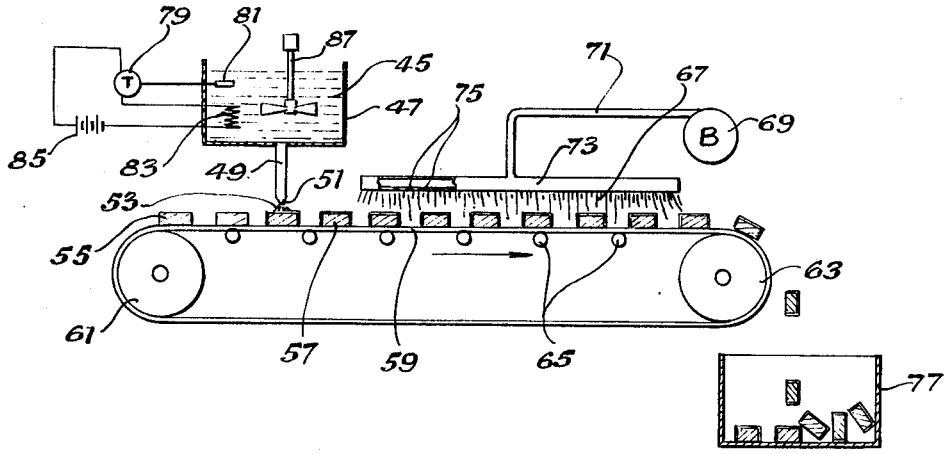
FIG. 2 is a schematic sectional elevation of a continuous apparatus for spraying a melt of conditioning agent onto surfaces of bases for fabric conditioning articles.

In FIG. 2 is shown the coating of a brick-shaped polystyrene foam base article on a face, sides and ends by means of a spray of conditioning composition. The light weight shaped foam may have corners and edges rounded for better contact with materials to be conditioned and for more even application of coating composition to the article. Composition 45 in tank 47 is gravity fed to sprayer 49 from which it is discharged through orifice 51, forming a spray 53 which coats the upper face, sides and ends of a base article 55 to produce a coated conditioning article 57. The articles to be coated with conditioning composition are fed past the sprayer 49 by continuous belt 59 which is advanced in the direction of the arrow over main rollers 61 and 63 and supporting rollers 65. The drive means for advancing roller 63 are not illustrated.

After the coating of conditioning agent has been sprayed onto the base article, the coated article is advanced along belt 59 to a cooling station, wherein air or other suitable cooling gas 67 is directed onto a plurality of the coated articles to cool them. The air is forced by blower 69 through duct 71, manifold 73 and out through a plurality of orifices therein, 75. The coated and cooled articles, on which coating composition has been solidified, are discharged into bin 77 and are ready for removal, packaging, storage, shipment and use.

The temperature of the coating composition is desirably regulated to the proper level, whereby also affected are the viscosity and spray rate thereof through the sprayer, by employing a thermostat 79 having a probe 81 in a tank of coating composition 45. The probe is responsive to temperatures lower than that desired so that at under such conditions electric heater 83 is activated and raises the temperature of the coating composition to that desired, at which point the heater is cut out by action of the thermostat. A source of electricity is designated by numeral 85. To maintain uniformity of the composition in the tank and to promote even heating thereof, stirrer 87 is employed.

In FIG. 3 is illustrated a means for coating a sheet or strip of base material with a fabric conditioning composition. Such apparatus is similar to that shown in FIG. 1. A special paper, fabric or polymeric sheet 91 is fed from roll 93 over or under spindle rollers 95, 97, 99 and 101 to take-up roll 103, which is motor activated. During the travel of the sheet in the direction of the arrow, it passes through conditioning composition 105 in tank 107. Such composition is at an elevated temperature to facilitate application to the base material 91 and the temperature is maintained at the desired level by means of a thermostat 108, having a probe 109 in the coating composition, which probe actuates a heater 111 when the temperature falls below that desired. Circulation of conditioning composition through the heater is effected by means of line 113, pump 115 and return line 117. Heater 111 is on only when thermostat 108 indicates that the conditioning composition requires more heat to maintain the desired coating temperature. After application of the coating, nip roll 102, in conjunction with roll 101, trims the coating to desired thickness on the strip. Then, blower 119 forces air through conduits 121 and 122 and through distributors 123 and 124, out orifices 125 and 126 and against both faces of the coated base material, whereby the coating is cooled and solidified so that the coated article may be rolled, cut, shaped or otherwise treated, packaged and stored, ready for use.

For simplicity of illustration, the spray means and cooling means employed in the apparatuses of FIGS. 1 and 2 have been shown acting on only one side of the article being treated. Clearly, additional such means may be used for coating and cooling other parts of such objects.

In FIG. 4 is illustrated a vertical sectional view of a coated object produced by the method illustrated in FIG. 1. This is a hollow ball 127 of paper, produced from pulp and uniformly coated with a layer of solidified conditioning composition 129. As will be seen from FIG. 4, a portion of the conditioning composition 129 has penetrated the surface of the paperboard to a slight degree, as indicated at 131. The rest of the paper is not impregnated with conditioning composition and the interior thereof is free of it. When a similar composition is applied as an aqueous or alcoholic solution, it penetrates the paperboard and creates, in addition to the solidified coating 133, an impregnated paperboard 135, illustrated in FIG. 5, which is undesirable. Also, in the drying operation the excess liquid that had soaked through the paperboard sphere to the interior thereof is evaporated and solid appears inside sphere wall 137 at 139. When used, the spheres illustrated in FIG. 5 give much less efficient transfers of coating compositions than do those of the type shown in FIG. 4, which are made according to the method of this invention.

The drawing illustrates methods of carrying out the present invention and advantages resulting therefrom. Especially when compared with the applications of solutions of conditioning compositions, greatly improved results are obtained by the present method, both in the method itself and the products which are results thereof. Broadly, the advantages of the present method are obtainable with a wide variety of conditioning materials, although the invention is primarily directed to the utilization of fabric softeners and antistatic agents. In addition to the preferred conditioners, other such agents that are employed in accordance with the present invention, either with the fabric softeners or separate therefrom, and either alone or in mixture with other conditioning agents are bactericides, fungicides, fire retardants, shrinkproofing agents, sizes, such as starch, soil repellents, creaseproofing agents, water repellents, stain repellent compounds, dyes and other coloring agents, lubricants, odor counteractants and perfumes. Various compounds of these types, which are solids, liquids or of a waxy nature are known and may be applied to base article to form conditioning articles. They are meltable at temperatures within suitable ranges for application and use but if they are not, the melting ranges thereof may be adjusted by the use of mixtures or of particular carriers of desired melting points. Thus, for example, petroleum waxes, fatty acids, mono-, di- and triglycerides may be employed, as may be mixtures of higher and lower melting conditioning agents. Viscosity depressants may also be used to thin down the coating material for more effective application. For example, 5% of sodium acetate may be so employed. In some cases, minor proportions of water and solvent, usually no more than 10% of each of these, preferably less than 5% thereof and most preferably, less than 2% thereof may be present to aid in maintaining a homogeneous conditioning composition and to help in adjusting the melting point. Of course, other plasticizers and solidifying agents known to the art may also be used to adjust softening and melting temperatures of the conditioning agents. It will be apparent however, that it is much preferable to use conditioning materials of melting points in the desired ranges so that solvents, plasticizers and carriers need not be employed.

With respect to fabric softeners and antistatic agents that are useful in making the fabric softening articles of this invention, various anionic, cationic and nonionic substances may be used. The utilities of many of these materials in fabric softening articles have been discovered by the present applicant and other workers in the research laboratories of his assignee company and the listing of such useful materials hereinafter is not to be considered as an indication that the present inventor discovered their utilities as coating compositions for fabric softening articles. Rather, he has found that they are applicable to base articles by means of his process, produce better fabric softening articles and are capable of being processed by the present inventive method more effectively than was the case when solutions thereof were applied. In some cases, knowledge of the present invention and the utilization of melts of conditioning agents may have aided in the discovery of such other useful compositions.

Among the fabric softeners and antistatic agents that are usable in accord with the present invention are the nonionic surface active materials, including higher fatty acid mono-lower alkanolamides, higher fatty acid di-lower alkanolamides, block copolymers of ethylene oxide and propylene oxide, having balanced hydrophilic and lipophilic groups, polymers of lower alkylene gylcols, polyalkylene glycol ethers of higher fatty alcohols and polyalkylene glycol esters of higher fatty acids. Among the anionic agents are the higher fatty acid soaps of water soluble bases, higher fatty alcohol sulfates, higher fatty acid mono-glyceride sulfates, sarcosides, taurides, isethionates and linear higher alkyl aryl sulfonates. Cationic compounds include the higher alkyl-di lower alkyl amines, di-higher alkyl lower alkyl amines and quaternary compounds, especially quaternary ammonium salts, e.g., quaternary ammonium halides.

Specific examples of surface active materials of the types described above are given in the text Synthetic Detergents by Schwartz, Perry and Berch, published in 1958 by Interscience Publishers, New York. See pages 25 to 143. Among the more preferred of these are:

Nonionic — nonylphenoxy polyethoxy ethanol; stearic monoethanolamide; stearic diethanolamide; block copolymers of ethylene oxide and propylene oxide (Pluronics ®);

Anionic — sodium soap of mixed coconut oil and tallow fatty acids; sodium stearate; potassium stearate; sodium laurate; tallow alcohols sulfate;

Cationic — dilauryl dimethyl quaternary ammonium chloride; hydrogenated tallow alkyl trimethyl ammonium bromide and benzethionium chloride.

Although various bases may be used, of different characteristics, shapes and materials of construction, with the advantages of the present invention resulting, it is generally preferred that the base article should be a solid which is dimensionally stable. Additionally, it is preferred that it be form retaining. Thus, although strips of flexible material may be processed by the method of this invention and will be manufactured more readily and will be of better characteristics than similar materials which are impregnated with a conditioning agent from solution or dispersion, such sheets or strips are not considered to be form retaining, although they may be characterized as dimensionally stable. Thus, they will tend to be folded or bent more readily, with possible cracking and release of coating material from the surfaces thereof, and therefore are not as advantageous for the present purposes as are the form retaining products, such as spheres, cylinders, bars or bricks of fairly light weight bases with conditioning composition coated onto the surfaces thereof. In addition to being form retaining, it is desirable that the materials used should be of a melting point so that they do not change shape drastically during application of the conditioning agent. Also, although they may be somewhat porous, the pore sizes should be small enough so that the conditioning composition melt does not penetrate the pores to such an extent that much of the conditioning material is made inaccessible to clothing or laundry to be treated by tumbling contact with the conditioning article. The degree of impregnation or penetration of the melt is dependent also on the viscosity thereof, which varies with the temperature employed. Processing technique also affects coating quality. For example, if cooling is too slow or is effected too late, more conditioning agent will be able to penetrate into the substrate. By controlling these four variables, penetration into the article to be coated is controllable. Among suitable materials of construction to be employed are paper, paperboard, molded paper pulp articles, wood, plastics, foamed plastics, e.g., polystyrene foam, cellulose foams, metals. The size of the base article may be regulated as desired and various sizes are suitable, ranging from volumes as small as that of a ⅛ inch sphere to as much as 0.1 cubic foot.

Coating methods that may be used include dipping and spraying, as illustrated in the drawing, plus the use of roll applicators or doctor blades, application of a stream of melt to a fast moving article surface, spattering or virtually any other suitable technique. In some cases, the melt may be created by contacting a heated base surface with a meltable solid conditioning agent.

Whatever the type of process employed to produce a melted conditioning agent, it will usually be desirable to have the temperature of the melted conditioning composition within the range of 40° C. to 200° C. Below the lower temperature, the product will normally be too susceptible to softening in storage. Even at about this lower temperature, the product would generally be employed without heat in order to rub off conditioning agent on fabrics to be treated, without excessive softening and melting of the conditioning agent, which would tend to cause spotting and staining of the laundry being treated. Products melting over 200° C. do not soften appreciably enough at the usual temperatures of an automatic dryer, usually about 50° C. to 90° C. Within the 40° C. to 200° C. range a preferred range of application temperatures to the conditioning article base is from 50° C. to 150° C. and it is most preferred that this be from 60° C. to 100° C. The melting point of the conditioning composition will usually be from 50° C. to 110° C., most preferably from 60° C. to 90° C. This melting point is of importance in connection with the action of the treated article on fabrics to be conditioned in an automatic dryer. Thus, the coating composition should be softened sufficiently by the temperature of the dryer so that, in conjunction with the softening and dissolving effect of moisture in the recently laundered clothing being dried, the conditioning material will be satisfactorily removed from the conditioning article and will be deposited on the clothing to be treated. By satisfactory application to the laundry it is meant that more than a minimal amount will be deposited during a normal drying cycle and the application rate will not be so great as to cause deposits of lumps of material on the clothing to be conditioned, with the resulting uneven softening and sometimes, with staining resulting.

At the temperatures of application mentioned, the viscosity of the conditioning composition will be a suitable viscosity, generally from 5 to 500 centipoises and preferably from 10 to 100 centipoises. At such viscosities, penetration of the pores of base materials, such as paperboard, corrugated board, polystyrene foam and wood, will not be so rapid as to cause impregnation of the article with conditioning composition. Generally, the penetration will be from 0.0001 to 0.010 inch, which is sufficient to allow the conditioning material to hold tightly to the substrate. Of course, the degree of penetration will depend in part upon the time of exposure of the article to be coated to the melt of conditioning composition. Therefore, this time will usually be kept quite short, generally from 0.001 to 30 seconds, and often, especially when sprays or "printing" roll applicators are used, about 1 second or less, e.g., 0.01 to 1 second. If desired, plural dips or sprays may be utilized to build up a coating of conditioning composition. To make certain that the coating is uniform on the object, the object may be spun, drained, reversed in position or treated in other manner to maintain a uniform coating of the molten conditioning agent on the base. Also, cooling should be effected rapidly to freeze the coating in position and to minimize penetration.

Cooling will normally be undertaken immediately after withdrawal of the article from the conditioning composition melt. Usually, no more than 10 seconds will go by before active cooling is effected and even before this time some cooling usually occurs by conduction and radiation. Conduction cooling may be accelerated by utilizing an initially cold article. The temperature of the cooling fluid, which is preferably a gas, such as air, but may also be any of other suitable gases, will usually be within the range of −10° C. to 60° C. and is preferably below ambient, generally no higher than 20° C. Cooling will usually be done quickly, preferably within from 0.1 to 30 seconds and most preferably will be almost instantaneous, generally being less than 1 second. A skin may be formed on the outside of the coated article by a blast of cooling air to freeze the coating composition in place in uniform thickness on the article.

The thickness of the coating composition may be controlled to be that most desirable for the particular use intended for the product. Coating thickness is controllable by the characteristics, sizes, settings and use conditions of nip rolls, doctor blades and spray nozzles and depends too on fluid viscosity. Generally, such thickness is from 0.0002 to 0.25 inch, preferably being from 0.001 to 0.10 inch and most preferably being from 0.001 to 0.01 inch. As was indicated previously, the thickness can be controlled by adjusting the coating temperature, the temperature of the object being coated, the temperature of the air blast, the viscosity and nature of the coating composition, spacing of nip rolls or doctor blades, nozzle sizes, etc.

The following examples are given to illustrate specific embodiments of the invention. They are not to be interpreted as limiting. Unless otherwise indicated, all measurements are given in inches, temperatures are in degrees Centigrade and parts are by weight.

EXAMPLE 1

Utilizing the apparatus illustrated in FIG. 1, hollow paper balls, about ⅛ inch thick having an outside diameter of about 2-½ inches and made from wood pulp, are dipped in a melt of 50 parts of stearic monoethanolamide and 50 parts of stearic diethanolamide at a temperature of 80° C. for a period of 10 seconds. The coated balls are withdrawn and are promptly (within 2 seconds) subjected to an air blast at 0° C., which almost immediately solidifies the coating exterior and maintains it of uniform thickness about the paper ball. Complete solidification takes place in about 20 seconds. The thickness of coating is about 0.10 inch, corresponding to a loading weight of about 3 grams. Loading weights of conditioner from about 0.5 to 15 grams per dryer load (5 to 10 lbs.) are useful. The conditioning composition penetrates the surface of the paper to a depth of about 1/64 inch and does not enter the hollow interior. The coated articles are tested by being added to an automatic laundry dryer during the one hour drying cycle in which 8 pounds of mixed laundry are dried at a temperature of about 80° C. After completion of drying, the laundry is found to be conditioned. It is soft and static-free. Examination of the coated balls shows that a significant proportion of the coating has been removed therefrom by a combination of softening by heat and moisture and rubbing against the tumbled laundry.

EXAMPLE 2

A composition comprising 1 part of potassium stearate and 2 parts of lauric monoethanolamide is heated to a temperature of about 100° C. and is sprayed onto polystyrene bricks having rounded edges and being of dimensions 3 inches × 2 inches × ½ inch, using an apparatus such as that illustrated in FIG. 2. The coating is applied to a thickness of about 0.15 inch to a face, sides and ends of the brick and spraying takes about 5 seconds per article. Within 10 seconds of spraying, the coated surfaces are cooled by air at a temperature of 10° C. and an air flow rate of about 500 feet per minute. The coating applied is sufficiently hard to be removed and dropped into a bin with other such items. After packing, cooling to room temperature, storing and shipping, such an item is tested with a 6 pound load of laundry, mostly cotton, but with some nylon and polyester-cotton blend fabrics, to be dried in an automatic dryer at 70° C. The brick is fastened to the dryer drum by suitable means, with conditioning surfaces outwardly disposed. After 45 minutes drying, the clothes are no longer damp and upon testing, it is shown that they are static-free and have been satisfactorily softened. Examination of the polystyrene foam brick shows that almost all the conditioning material has been removed from the surfaces thereof.

In similar manner, following the above-described procedure, other conditioning compositions are applied to different articles. Thus, mixtures of sodium coco-tallow fatty acids kettle soap (1 part), lauric monoethanolamide (1 part), stearic diethanolamide (0.6 part) and perfume (0.2 part) may be applied, either with or without the addition of 1 part of paraffin, to articles of paper, vermiculite, polyurethane foam (rigid), balsa wood, or wire mesh. Surprisingly, although the perfume is volatile, it does not flash off significantly and therefore, is useful as a conditioning agent. Also, water and alcohol may be present as long as the quantity employed does not require evaporation to solidify the coating on the base article, when cooled.

Thicknesses may be regulated by modifying the temperature, viscosity, spray pressure, time of dwell in the spraying zone, temperature of the article being sprayed, nip roll and doctor blade settings, nozzle size, etc. Also, greater thicknesses may be obtained by passing the object through the spray zone a plurality of times. Products so made according to this example will have conditioning effects on laundry, will not excessively penetrate the base article surface and will be satisfactorily removed from that article to be deposited on the laundry without staining or spotting.

EXAMPLE 3

Paper strips are made, coated on both sides with a softening and antistatic composition comprising 5 parts stearic monoethanolamide, 2 parts dimethyl dihydrogenated tallow ammonium chloride, 0.1 part bactericide (benzethonium chloride), 0.1 part fluorescent brightener (stilbene derivative) and 0.2 part perfume, together with 1 part of Carbowax ®400 (polyoxyethylene). A melt of the conditioning composition is made and held at a temperature of 100° C., using the apparatus of FIG. 3. A sheet or strip of paper, standard bond having 25% cotton content and being about 0.005 inch thick, is fed into the melt, held there for about 5 seconds, while moving forward, withdrawn through nip rolls to regulate coating thickness and is then cooled by air flow, with the air being at 15° C. Cooling occurs almost instantaneously and a thickness of coating composition of about 0.005 inch is obtained on each side of the paper. The paper is held in the air stream for about 10 seconds and is then sufficiently hard to be rolled. Subsequently, after further cooling, it is cut, if desired, packed, stored and shipped for ultimate use. When sheets of said paper of dimensions 6 inches × 12 inches are used, in a standard automatic clothes dryer with an 8 pound load of mixed cotton, polyester and nylon fabric laundry, with the cotton articles comprising a major proportion thereof, excellent softening is obtained and most of the conditioning composition is removed from the paper. In some cases, the paper becomes folded so that transfer of conditioning composition is inhibited and in such situations conditioning is not as effective. It is also noted that the clothing treated has bactericides, brightener and perfume thereon, contributing their properties to the treated articles.

Some of the compositions described hereinabove are subjects of other patent applications of the present applicant and other researchers at the laboratories of his assignee company. They are described herein to illustrate the present invention but is not to be considered that such described composition, article or methods of use are claimed as the invention of the present inventor. His present invention relates primarily to a method for making these conditioning articles more safely, efficiently and economically than was previously known.

This invention has been described with respect to drawings, illustrations and examples thereof but it is clear that it is not to be limited to them but embraces equivalents within the spirit of the invention.

What is claimed is:

1. A method of manufacturing an article for conditioning fabrics by contacting said fabrics with said article to apply a fabric softener composition to the surfaces of said fabrics which comprises raising the temperature of said fabric softener composition selected from amides, alkanolamide, polyoxy lower alkylene containing synthetic organic nonionic surface active agents; higher fatty acid soaps or synthetic organic anionic surface active softeners; quaternary ammonium, cationic surface active softeners, amine cationic surface active softeners, mixtures of soft softener composition with additional softeners, compatible with said softener composition; or mixture of said softener compositions with non-interfering carriers which improve the melting and solidification characteristics of said softener composition until it forms a melt, said melt being substantially free of solvent materials and compounds which would have to be removed to solidify said fabric softener composition at ambient temperature of higher temperature to which said melt is cooled, maintaining said melt at a temperature of from 40° C. to 200° C. at which temperature said melt is a fluid of from 10 to 100 cps viscosity and readily applicable to a base for the fabric softener article, the pore size of said base being sufficiently small to minimize penetration of said melt into said base, applying said melt to said base article so that a surface thereof, adapted to contact said fabric is coated with said melt, said base being substantially solid, dimensionally stable and form-retaining at the temperature of application of said fabric softener composition, and rapidly cooling said composition on said surface at a temperature within the range of from −10° C. to 60° C. so as to convert said composition to a solid state, wherein said composition forms a coating on said base, said coating having a thickness of from 0.0002 to 0.25 inch, the maximum penetration of said melt into said base being about 0.01 inch, and said base has a thickness of at least ⅛ inch, said fabric softener composition being sufficiently softened by heat, moisture of a combination of heat and moisture in an automatic laundry dryer so as to be deposited on tumbling moist laundry in contact with said fabric softening composition.

2. The process of claim 1 wherein said softener composition melts at a temperature of from 50° C. to 110° C. and wherein said melt is maintained at a temperature of from 50° C. to 150° C.

3. The process of claim 1 wherein the temperature at which the melted conditioning composition is applied to the base is from 80° C. to 120° C. and cooling is effected to a temperature within the range of 10° C. to 40° C.

4. A method according to claim 1 wherein application of said softener composition to said form retaining base is effected by immersing said surface portion of said base to be coated in a melt of said softener composition so that a coating of said softener composition on said surface of said base is produced, and the cooling of said softener composition is effected by contact thereof with a cooling gas after removal of the coated base article from said melt of said softener composition.

5. A method according to claim 4 wherein a plurality of from retaining bases is sequentially and continuously coated by at least partial immersions in a melt of softener composition, the thickness of the coating on the base is regulated by modifying the temperature of the melt, which adjusts the viscosity and coating activity thereof, and cooling is effected by flowing cooling air over the coated surface of the softening article after removal from said melt of softening composition.

6. A method according to claim 5 wherein the time of immersion of the base to be coated with softener composition in the melt of softener is from 0.001 to 30 seconds, and the cooling of the softener composition to the solid state, after removal from the melt, takes place in from 0.1 to 30 seconds.

* * * * *